US008087343B2

(12) United States Patent
Landies et al.

(10) Patent No.: US 8,087,343 B2
(45) Date of Patent: Jan. 3, 2012

(54) M240 RIFLE WITH SELECT FIRE MECHANISM FOR SELECTIVE FULLY-AUTOMATIC AND SEMI-AUTOMATIC OPERATION

(75) Inventors: Robert I. Landies, Chardon, OH (US); Thomas M. Hardman, Chesterland, OH (US); Daniel L. Albright, Chardon, OH (US); Joshua G. Hershberger, Concord Township, OH (US)

(73) Assignee: Ohio Ordnance Works, Inc., Chardon, OH (US)

( * ) Notice: Subject to any disclaimer, the term of this patent is extended or adjusted under 35 U.S.C. 154(b) by 203 days.

(21) Appl. No.: 12/687,561

(22) Filed: Jan. 14, 2010

(65) Prior Publication Data

US 2011/0168008 A1 Jul. 14, 2011

(51) Int. Cl.
*F41A 19/33* (2006.01)

(52) U.S. Cl. ..... 89/140; 89/139; 89/132; 89/128

(58) Field of Classification Search ..... 89/139, 89/140, 129.01, 132, 142, 148, 128
See application file for complete search history.

(56) References Cited

U.S. PATENT DOCUMENTS

| | | | | |
|---|---|---|---|---|
| 4,023,465 | A * | 5/1977 | Inskip | 89/131 |
| 4,056,038 | A * | 11/1977 | Rath | 89/128 |
| 5,663,522 | A * | 9/1997 | Kuehl | 89/128 |
| 7,562,614 | B2 * | 7/2009 | Polston | 89/139 |
| 7,578,227 | B1 * | 8/2009 | Jacob | 89/141 |
| 7,600,338 | B2 * | 10/2009 | Geissele | 42/69.03 |
| 7,676,974 | B2 * | 3/2010 | Zemanek | 42/69.02 |
| 7,779,741 | B2 * | 8/2010 | Polston | 89/33.01 |
| 7,895,933 | B2 * | 3/2011 | Quis | 89/139 |
| 7,950,178 | B1 * | 5/2011 | Landies et al. | 42/69.01 |
| 2007/0266845 | A1 * | 11/2007 | Polston | 89/139 |

* cited by examiner

*Primary Examiner* — Michael David
(74) *Attorney, Agent, or Firm* — Renner Kenner Greive Bobak Taylor & Weber

(57) ABSTRACT

A trigger assembly for a trigger housing for an M240 Assault Rifle is provided having a switch accessible at the outside of the trigger housing for changing the firing of the rifle between semi-automatic and fully-automatic fire.

3 Claims, 6 Drawing Sheets

M240 RIFLE WITH SELECT FIRE MECHANISM FOR SELECTIVE FULLY-AUTOMATIC AND SEMI-AUTOMATIC OPERATION

FIELD OF THE INVENTION

This invention relates to an M240 machine gun including a select fire mechanism that permits the gun to be selectively operated to be either fully automatic or semi automatic.

BACKGROUND OF THE INVENTION

This invention provides a select fire mechanism for an M240 automatic rifle that permits the rifle to be operated to be either fully automatic or semi-automatic. The typical M240 is a gas operated, air cooled automatic firearm. Expanding gases from the ignition of powder in the cartridge furnishes the energy for the operation or cycling of the rifle. Immediately after firing, as the bullet traverses the barrel and passes an internal gas port prior to exiting from the muzzle, the live gases expand through the gas port into the gas tube or cylinder to impinge against the head of a piston. In so doing, the piston within the gas cylinder is forced rearwardly, toward the buttstock, driving an operation rod assembly (herein "op rod assembly") which cycles a combination of internal components while compressing a recoil spring that effects the return movement.

The op rod assembly carries the firing pin and a bolt link pivotally secures the op rod assembly to the bolt lock. As the op rod assembly begins to travel rearwardly under the influence of the expanding gases resulting from the firing of a cartridge, the bolt link rotates and pulls the bolt lock up out of its cradle in the receiver, thereby unlocking the bolt from the receiver. Once free from the mating receiver surfaces, the bolt travels rearwardly with the bolt link and op rod assembly as it continues its rearward travel. In so doing, several additional operations continue. Cartridges for the M240 are belt fed, and the bolt carries a roller that engages a feed lever to feed cartridges into the receiver in a known manner, during this rearward travel. The op rod assembly contacts a buffer in the buttstock, halting its rearward movement, and immediately begins return travel in response to the compression of the recoil spring. Continued forward movement is then a function of the position of the trigger.

Assuming the trigger remains depressed, the sear will not engage the sear ledge on the underside of the op rod assembly and thus the op rod assembly will continue forward under the influence of the recoil spring. During the forward movement, the bolt strips a cartridge from the belt for chambering. Because they are associated with the op rod assembly, the bolt, bolt lock and bolt link also move forward until the very last increment of movement. The bolt moves until the cartridge is seated, which limits the forward movement of the bolt so that the bolt link is caused to rotate downward, lowering the bolt lock into locking engagement with the receiver, at which stage, the bolt cannot move rearwardly. Directly thereafter, the firing pin carried by the op rod assembly is forced to strike the primer of the chambered cartridge, thereby firing it whereby the above firing sequence is repeated in response to sustained depression of the trigger or until the ammunition is exhausted.

Repeat of this cycle is dependent upon the trigger remaining in the fired position. If the operator releases the trigger, the sear is immediately raised into the path of the sear ledge on the reciprocating op rod assembly. In rearward travel, the op rod assembly can push the sear down to pass over it. However, upon the return, the sear is raised by a spring and engages the sear ledge, halting continued forward movement of the op rod assembly. When this occurs, the action remains opened, and no new round is loaded. Accordingly, the M240 rifle is one which fires from the open bolt and, as soon as the trigger is again pulled, the sear is pulled out of engagement with the sear ledge, allowing the op rod assembly to move forward causing all of the foregoing operations. The bolt closes, taking with it a fresh round from the belt, which is simultaneously chambered and instantaneously thereafter fired, as the foregoing sequence is allowed to repeat.

Because fully automatic fire is not always needed and not always desired, the prior art has provided means for converting M240 rifles to fire only semi-automatically. An example of one such means is provided in co-pending U.S. patent application Ser. No. 12/411,026. The conversion shown therein is quite permanent, such that the M240, once converted to semi-automatic fire, is not readily converted back to fully automatic fire. It is believed there is a need in the art for an M240 rifle that includes a select fire mechanism permitting the rifle to be selectively operated as a fully automatic firearm or a semi automatic firearm.

SUMMARY OF THE INVENTION

The present invention generally provides a trigger assembly fitted to a trigger housing that is adapted to engage a receiver for an M240 Assault Rifle. As known for the M240 Assault Rifle, the receiver carries an op rod assembly that reciprocates within the receiver to fire the rifle. The trigger assembly of this invention includes a sear pivotally mounted to the trigger housing, the sear providing a sear tip and a latch end. A sear spring of the trigger assembly biases the sear to pivot to position the sear tip in the path of the op rod assembly when the trigger housing is engaged with the receiver and the trigger assembly is unactuated. The trigger assembly further includes a trigger pivotally mounted to the trigger housing, and a disconnector pivotally connected to the trigger. The disconnector provides a ramped surface and a catch end that is adapted to engage the latch end of the sear. The trigger assembly further includes a select fire mechanism including a switch that is accessible outside of the trigger housing and selectively movable between a fully automatic firing position and a semi automatic firing position, and a selector body is associated with the switch. The selector body includes a fully-automatic selector surface and a semi-automatic selector surface, and moving the switch between the fully automatic firing position and the semi-automatic firing position also moves the selector body between a fully automatic firing position and a semi-automatic firing position. A disconnector spring biases the disconnector toward the sear and the selector body, and actuating the trigger assembly draws the ramped surface of the disconnector against the selector body and, when the switch is in the fully-automatic firing position, the ramped surface is drawn against the fully-automatic selector surface and, when the lever is moved to the semi-automatic firing position, the ramped surface is drawn against the semi-automatic selector surface. When the ramped surface is drawn against the fully-automatic selector surface, the catch end of the disconnector engages the latch end of the sear and pulls thereon so as to pivot the sear tip out of the path of the op rod assembly and remain out of the path until the trigger is released, and, when the ramped surface is drawn against the semi-automatic selector surface, the catch end of the disconnector engages the latch end of the sear and pulls thereon so as to pivot the sear tip out of the path of the op rod assembly and thereafter disengages such that the sear pivots on the sear spring to again extend into the path of the op rod assembly after a single firing of the M240 Assault Rifle.

In a particular embodiment, the switch is a lever connected to the selector body, and the selector body is a longitudinal member having a longitudinal axis about which the longitudinal member rotates as the lever is moved. In this particular embodiment, the selector body includes a clearance cut defining a peripheral contact surface and a clearance cut surface. The peripheral contact surface serves as the semi-automatic selector surface in this embodiment, and the clearance cut surface serves as the fully-automatic selector surface.

DETAILED DESCRIPTION OF ILLUSTRATIVE EMBODIMENTS

Figure 1:
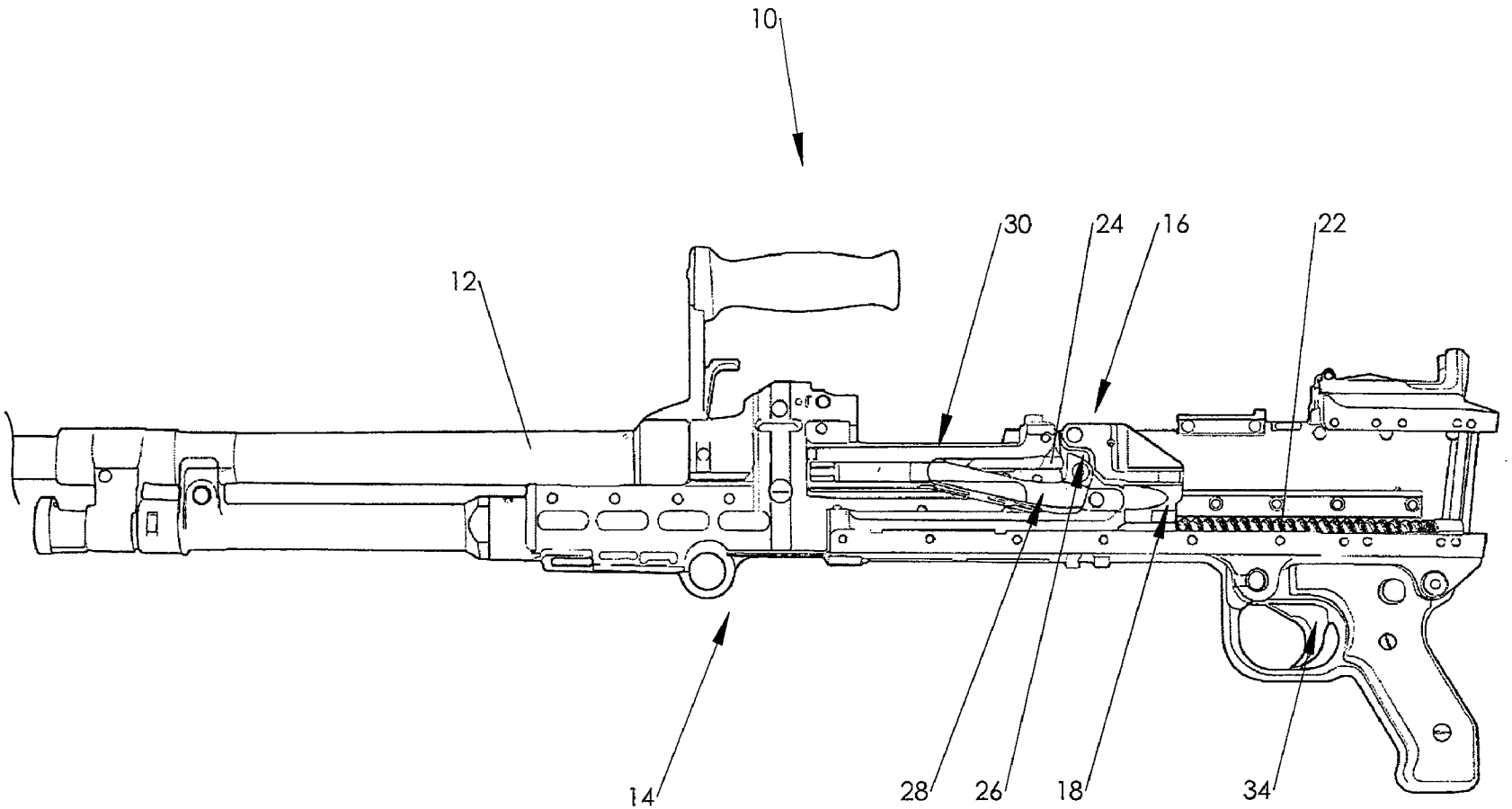
FIG. 1 is a side elevation view in partial cross section showing a portion of a prior art rifle, particularly an M240 fully automatic rifle, which is to be modified for semi-automatic fire in accordance with a particular embodiment of this invention.

This invention relates to the M240 Automatic Rifle, Caliber 7.62×51 mm, including the known model variations. A portion of such a rifle is depicted in FIG. 1 and is indicated generally by the numeral 10. The rifle 10 includes a barrel 12, threadably carried by a receiver 14. The receiver houses a striking mechanism 16. The striking mechanism 16 includes a gas operated op rod assembly, indicated generally by the numeral 18, which reciprocates in a gas cylinder beneath the barrel 12. The gas cylinder receives some of the expanding gases resulting from the firing of a cartridge, and these expanding gases impinge upon a piston portion of the op rod assembly 18. Thus, the op rod assembly 18 is driven rearward (to the right in FIG. 1), away from the muzzle of the barrel by gases formed when a cartridge is fired, and is then driven forward (to the left in FIG. 1) by a return spring 22.

The forward and backward movement of the op rod assembly 18 cycles internal components, commonly referred to as the action. After a cartridge has been fired, the op rod assembly 18, which carries a firing pin 24, is forced rearward and the fired cartridge is extracted and ejected through known mechanisms. This movement of the op rod assembly 18 pulls on the bolt link 26, causing it to pivot and pull the bolt lock 28 up out of its cradle in the receiver 14, thereby unlocking the bolt 30 from the receiver 14. Once free from the mating receiver surfaces, the bolt 30 travels rearwardly with the bolt link 26 and op rod assembly 18, and the op rod assembly 18 contacts a buffer in the buttstock, halting its rearward movement, and immediately begins to travel forward in response to the extension of the return spring 22. During forward movement, a fresh cartridge is stripped from a belt or magazine or the like (in accordance with the type of cartridge loading mechanism associated with the rifle 10) and chambered, and the bolt 30 moves until the cartridge is seated, which limits the forward movement of the bolt 30 so that the bolt link 26 is caused to rotate downwardly, lowering the bolt lock 28 into locking engagement with the receiver, at which stage, the bolt 30 cannot move rearwardly. Directly thereafter, the firing pin 24 carried by the op rod assembly 18 is forced to strike the primer of the chambered cartridge, thereby firing it, whereby the above firing sequence is repeated so long as the sear associated with the trigger 34 remains out of the path of a sear ledge machined into the op rod assembly 18. In this embodiment, a belt feed and associated roller mechanism is employed to feed rounds into the receiver, as is known for the M240. The sear remains out of the path of the sear ledge so long as the trigger 34 remains depressed, but extends into the path of the sear ledge to catch and hold the op rod assembly 18 from further cycling when the trigger 34 is released. A buttstock (not shown) is provided rearwardly of the trigger housing (to the right in FIG. 1), and allows shoulder firing of the rifle, as is conventional with all styles and types of rifles.

Thus, the original M240 Rifle is provided with a striking mechanism for fully automatic operation. Fully automatic fire, or true "automatic" occurs when the trigger of the firearm is pulled or depressed without release and a plurality of cartridges are continuously cycled through the rifle, each being fired in succession until either the trigger is released or the supply of cartridges has been exhausted. As soon as the trigger is released, firing ceases; when it is again depressed automatic firing re-commences, assuming a remaining supply of cartridges.

The typical trigger assembly for an M240 includes the aforementioned trigger 34 which is connected to a disconnector. A rearward pull of the trigger lifts the front arm of the sear by a small roller that is riveted into the trigger body. This motion also engages the front of the sear body with the disconnector on the trigger. The upward motion on the front of the sear causes the sear tip, located at the rear of the sear body, to rotate downward and release the sear ledge of the op rod assembly 18. At this time the machine gun will fire fully automatic until the trigger is released. When the trigger is released, the disconnector rises up above the top plane of the trigger housing. This puts the disconnector in the path of the reciprocating op rod assembly which will trip the disconnector causing it to release the sear, which is under upward tension from the sear spring, back into the path of the op rod and thereby catching the sear ledge of the op rod assembly and cease automatic firing. This is a well known operation to those of ordinary skill in the art, and the structures for effecting this fully automatic firing are also well known.

In the present invention, the M240 such as that generally described above is provided with a different select fire trigger assembly providing a select fire mechanism. The select fire trigger assembly is shown in FIGS. 2-6 and designated by the numeral 140. The select fire trigger assembly 140 is provided in a trigger housing 141 that connects to a receiver to communicate with the striking mechanisms, as is common for trigger assemblies. In this invention, the trigger housing 141 connects to a receiver such as receiver 14 so that the trigger assembly 140 can communicate with the op rod assembly 18 to allow or prevent the reciprocation thereof and hence allow or prevent firing.

The select fire trigger assembly 140 includes a trigger 142 that is pivotally carried on a trigger pin 144. The crescent portion of the trigger 142 is below the pivot point established by the trigger pin 144, but the body of the trigger 142 extends above that pivot point to interact with a disconnector 146 pivotally secured to the trigger 142 by a disconnector pin 148. The disconnector 146 is biased by a disconnector spring 150 to engage a latch end 152 of a sear 154. The disconnector spring 150 is a compression spring acting between a mount 143 on the trigger 142 and a mount 147 on the disconnector 146 and applies force between the two such that the disconnector 146 is forced against the sear 154 and/or a selector body 164. It should be noted that, in FIGS. 3 and 5, the disconnector spring 150 is shown as being off of mount 147, merely as a result of the program employed to create the figures, and it should be appreciated that the mount 147 provides the area of receipt for the end of the disconnector spring 146 that is opposite the end secured at mount 143 on the trigger. The pulling of the trigger 142 (rightward in the drawings) causes the disconnector 146 to be pulled forward and interact with the sear 154 and the selector body 164 as will be described more fully below.

Figure 3:
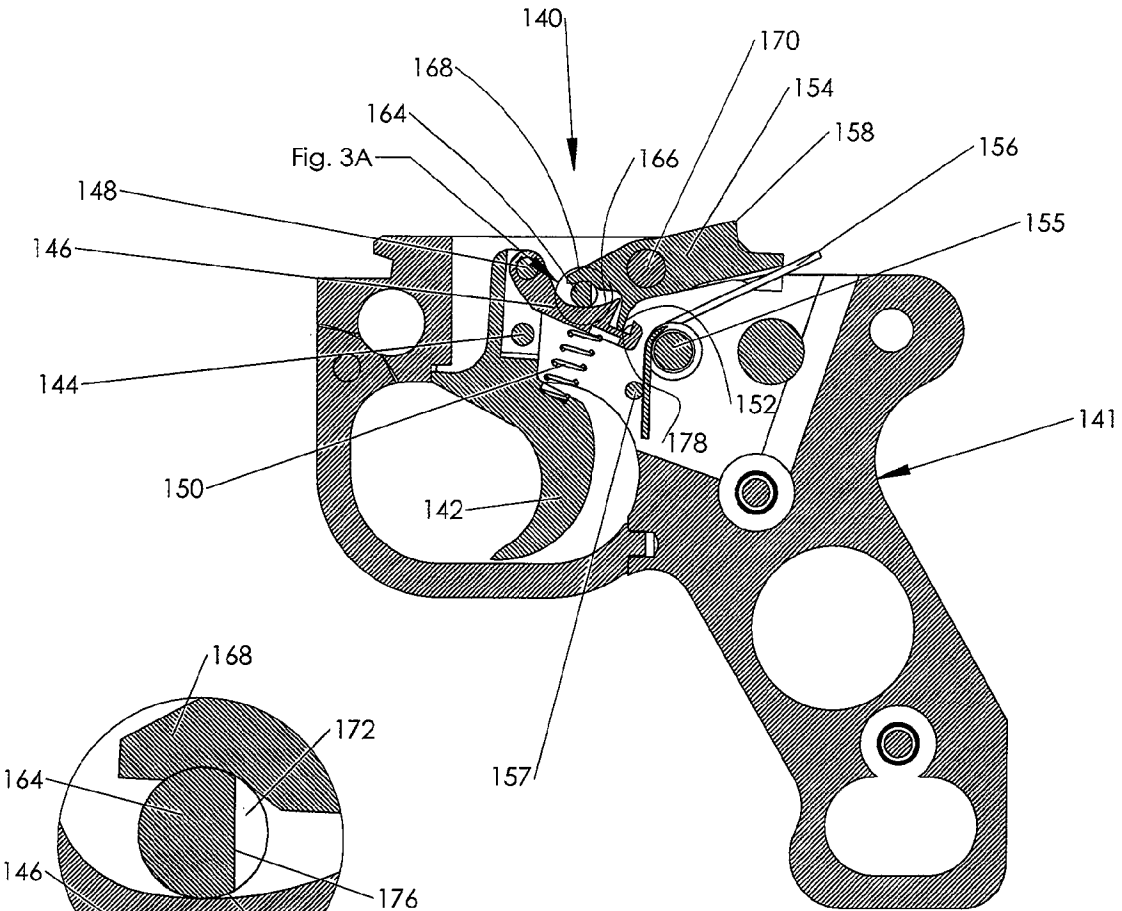
FIG. 3 is a cross section taken through the center of the sear and showing the internal components of the select fire trigger assembly in accordance with this invention, the components being shown in semi-auto mode, with the trigger at rest.
Figure 4:
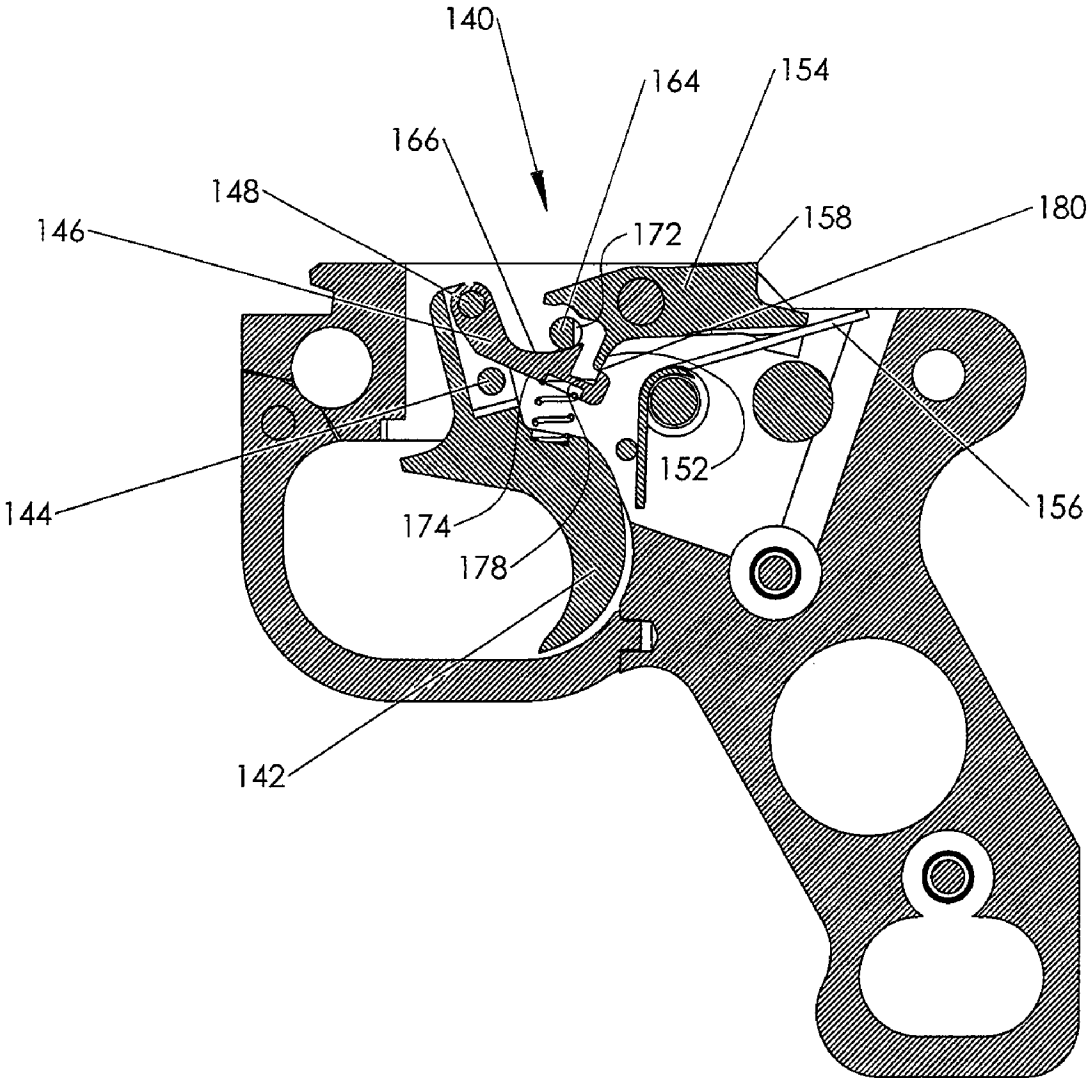
FIG. 4 is a cross section as in FIG. 3, showing the semi-auto mode as fired, at the position where the sear releases from the disconnector.

The sear 154 is itself biased for limited rotational movement by a sear spring 156. The sear spring 156 is shown as a torsion spring, being wound about a sear spring pin 155 and having one end extending to act upon the sear 154 and another end extending to act upon a sear spring stop pin 157. Though a torsion spring is a preferred spring due to the force it can impart against the sear 154, other springs could be mounted in the trigger housing 141 to function in a similar manner. With reference to FIGS. 3 and 4, it can be seen that the sear 154 provides a sear tip 158 that extends above the top boundary of the trigger housing 141 so that, when the trigger housing is connected to a receiver 14, it can engage a sear ledge provided on the op rod assembly 18, as generally known.

Figure 2:
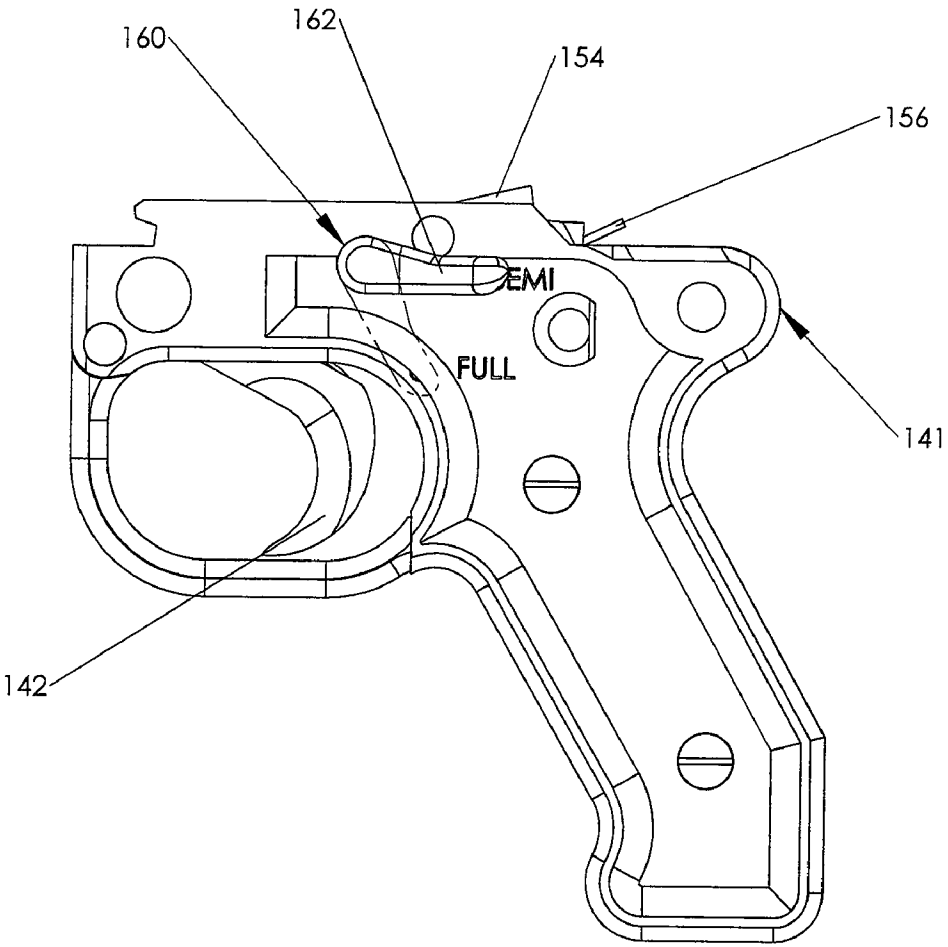
FIG. 2 is a side view of a select fire trigger assembly in accordance with this invention, showing the external grip portions and a lever of a select fire mechanism.

The select fire trigger assembly 140 includes a select fire mechanism 160 that provides a lever 162 to be moved between a semi-automatic firing position (shown at the word "semi" in FIG. 2, though the "S" is covered by the lever 162) and a fully automatic firing position (shown at the word "full" in FIG. 2). In FIG. 2, the lever 162 has been moved to the semi-automatic firing position, and the fully-automatic position for the lever 162 is shown in phantom lines. The lever 162 is accessible at the exterior of the trigger housing 141 so that it can be moved between these positions. As their names imply, when the lever 162 is moved to the semi-automatic firing position, at "semi," the trigger assembly 140 will function to permit a single cycling of the op rod assembly, and hence semi-automatic firing, when the trigger 142 is squeezed, and, when the lever 162 is moved to the fully-automatic firing position, at "full," the trigger assembly 140 will function to permit continuous cycling of the op rod assembly, and hence fully-automatic firing, so long as the trigger 142 remains pulled.

Figure 3A:
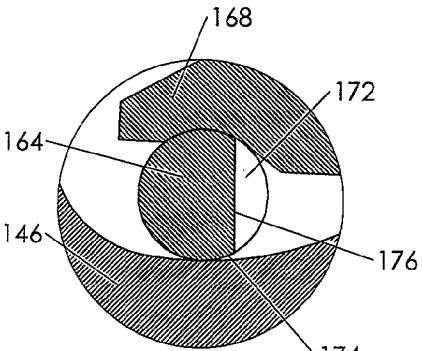
FIG. 3A is an enlarged view of the detail identified in FIG. 3 as Detail 3A.

With reference to FIGS. 3-6, the select fire mechanism 160 alters the functioning of the trigger assembly 140 by means of a selector body 164, which is connected to the lever 162 so as to rotate when the lever 162 is pivoted between the semi- and fully-automatic firing positions. The selector body 164 is positioned between the disconnector 146 and the sear 154, and serves as a stop for both the disconnector 146, as its ramped surface 166 is pushed against the selector body 164 by disconnector spring 150, and the sear 154, as its front end 168 is forced against the selector body 164, about sear pin 170, by sear spring 156. The selector body 164 includes a clearance cut 172, which defines a peripheral contact surface 174 and an inset contact surface 176 (see FIG. 3A), and it is this clearance cut 172 that is repositioned by movement of the lever 162 to bring about the desire firing, semi or full automatic.

In FIG. 3, the trigger assembly 140 is shown at rest, with the select fire mechanism 160 in the semi-automatic firing position. In this position, the ramped surface 166 of the disconnector 146 faces the selector body 164 with the selector body 164 positioned between the front end 168 of the sear 154 and the sloped surface 166. When the trigger 142 is pulled, as shown in FIG. 4, the disconnector 146 is pulled forwardly at disconnector pin 148 pulling the ramped surface 166 of the disconnector 146 against the peripheral contact surface 174 of the selector body 164, thus forcing the disconnector 146 to also move downwardly against the disconnector spring 150. Notably, the clearance cut 172 is not engaged by the ramped surface 166, rather, the ramped surface 166 engages the peripheral contact surface 174, thus bringing about a larger downward movement than would be achieved if the ramped surface 166 engaged the inset contact surface 176. The forward and downward movement causes the catch end 178 of the disconnector 146 to pull on the latch end 152 of the sear 154, thus causing the sear 154 to pivot about sear pin 170 until the sear tip 158 is made to disconnect from the sear ledge of the op rod, thus leading to the firing of a cartridge. The sear tip 158 pivots downwardly, out of the path of the op rod assembly and thus out of engagement with the sear ledge provided on the op rod assembly. At substantially the same time, the disconnector 146 disconnects from the sear 154, as shown right at the point of sear release, represented at 180 in FIG. 4.

After this disconnection, the sear 154 is able to move independently of the trigger 142, under the influence of sear spring 156, to again extend into the path of the op rod assembly and catch the sear ledge as it travels back under the influence of the expanding gases from the firing of the cartridge. The selector body 164 provides a stop for the pivoting of the sear 154 under the influence of the sear spring 156, and the sear 154 returns to its rest position of FIG. 3. At the rest position, the sear 154 can be reengaged with the trigger 142, at the disconnector 146, when the trigger 142 is released. Then the trigger 142 can be pulled again to fire another cartridge, and so on. Thus, in the semi-automatic firing position, the selector body 164 is positioned to cause a complete disengagement of the disconnector 146 from the sear 154, permitting the sear spring 156 to return the sear 154 to a position to engage the sear ledge of the op rod assembly and thus halt firing after the firing of one cartridge.

Figure 5:
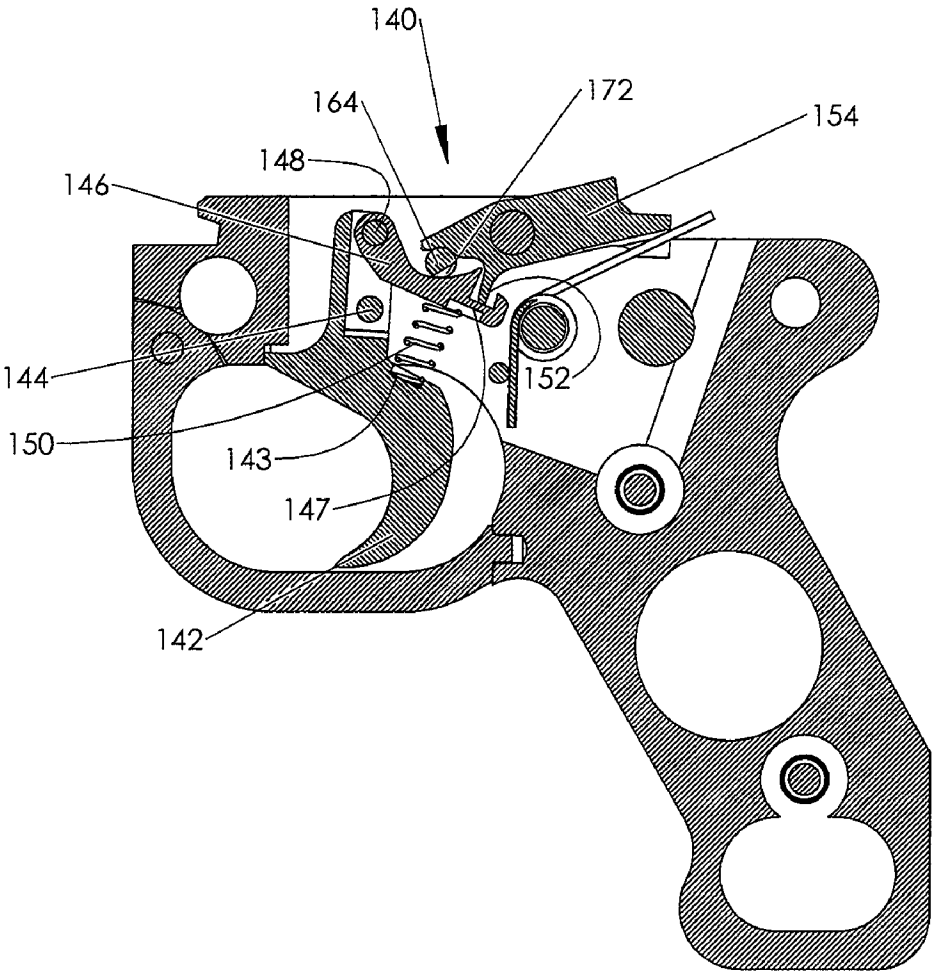
FIG. 5 is a cross section taken through the center of the sear and showing the internal components of the select fire trigger assembly in accordance with this invention, the components being shown in full-auto mode, with the trigger at rest.
Figure 6:
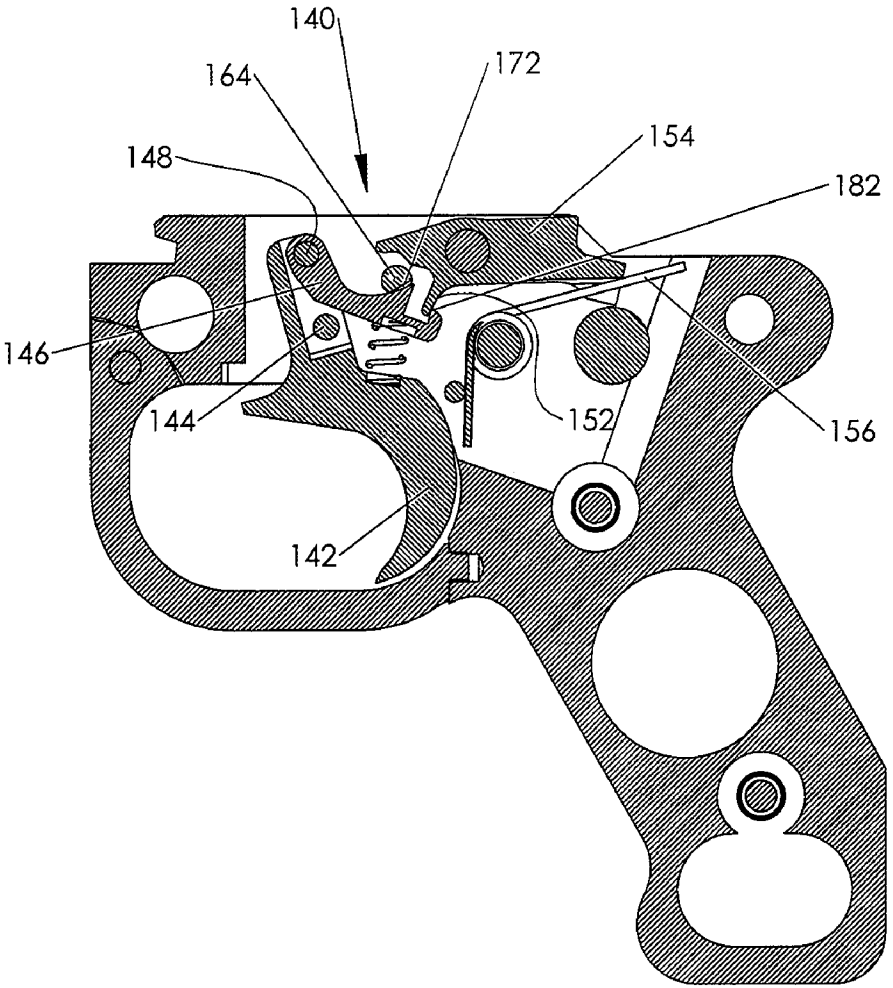
FIG. 6 is a cross section as in FIG. 5, showing the full-auto mode as fired, with the sear remaining associated with the disconnector.

In FIG. 5, the trigger assembly 140 is shown at rest, with the select fire mechanism 160 in the fully-automatic firing position. In this position, the ramped surface 166 of the disconnector 146 faces the selector body 164 with the selector body 164 positioned between the front end 168 of the sear 154 and the sloped surface 166. But in contradistinction to the positioning shown in the semi-automatic firing position, the selector body 164 is positioned such that, when the trigger 142 is pulled, as shown in FIG. 6, the disconnector 146 is pulled forwardly at disconnector pin 148 pulling the ramped surface 166 of the disconnector 146 against the inset contact surface 176, as opposed to the peripheral contact surface 174 of the selector body 164. Thus though the disconnector 146 is moved downwardly against the disconnector spring 150, similarly to the movement experienced in the semi-automatic firing position, the downward movement is smaller than would be achieved if the ramped surface 166 engaged the peripheral contact surface 174. As a result, the catch end 178 of the disconnector 146 will pull on the latch end 152 of the sear 154 but will not disengage from the latch end 152, as occurs in the semi-automatic firing position. This engagement is specifically identified in FIG. 6 at 182. The sear 154 will pivot about sear pin 170 until the sear tip 158 is made to disconnect from the sear ledge of the op rod, thus leading to the firing of a cartridge. The sear tip 158 pivots downwardly, out of the path of the op rod assembly and thus out of engagement with the sear ledge provided on the op rod assembly, and, because the disconnector 146 does not disconnect form the sear 154, the sear tip 158 will remain out of the path of the sear ledge so long as the trigger 142 remains pulled, and the op rod assembly will continue to cycle and fire in a fully automatic mode. Releasing the trigger 142 will permit the sear spring 156 to return the sear 154 to the rest position where it is able to engage the sear ledge of an op rod assembly and halt the firing until the trigger is pulled again.

In accordance with this invention, an M240 can be provided to have a select fire mechanism that is manipulated to cause the M240 to be selectively operated to be either fully automatic or semi automatic.

Based upon the foregoing disclosure, it should now be apparent that the present invention provides advances in the art by providing an M240 that can be selectively operated as either semi-automatic or fully automatic. The invention should not be limited to or by a particular disclosure made herein inasmuch as the scope of the invention shall include all modifications and variations that may fall within the scope of the attached claims.

What is claimed is:

1. A trigger assembly fitted to a trigger housing that is configured to engage a receiver for an M240 Assault Rifle, the receiver carrying an op rod assembly that reciprocates within the receiver to fire the rifle, the trigger assembly comprising:

(a) a sear pivotally mounted to the trigger housing, the sear providing:
  (i) a sear tip, and
  (ii) a latch end;

(b) a sear spring biasing said sear to pivot to position said sear tip in the path of the op rod assembly when the trigger housing is engaged with the receiver and the trigger assembly is unactuated;

(c) a trigger pivotally mounted to the trigger housing;

(d) a disconnector pivotally connected to said trigger, said disconnector providing:
  (i) a ramped surface, and
  (ii) a catch end configured to engage said latch end of said sear;

(e) a select fire mechanism including:
  (i) a switch accessible outside of the trigger housing and selectively movable between a fully automatic firing position and a semi automatic firing position,
  (ii) a selector body including a fully-automatic selector surface and a semi-automatic selector surface, said selector body positioned within the trigger housing and associated with said switch such that moving said switch between said fully automatic firing position and said semi-automatic firing position also moves said selector body between a fully automatic firing position and a semi-automatic firing position; and (f) a disconnector spring biasing said disconnector toward said sear and said selector body, wherein actuating the trigger assembly draws said ramped surface of said disconnector against said selector body and, when said switch is in said fully-automatic firing position, said ramped surface is drawn against said fully-automatic selector surface and, when said lever is moved to said semi-automatic firing position, said ramped surface is drawn against said semi-automatic selector surface, and wherein, when said ramped surface is drawn against said fully-automatic selector surface, said catch end of said disconnector engages said latch end of said sear and pulls thereon so as to pivot said sear tip out of the path of the op rod assembly and remain out of said path until said trigger is released, and, when said ramped surface is drawn against said semi-automatic selector surface, said catch end of said disconnector engages said latch end of said sear and pulls thereon so as to pivot said sear tip out of the path of the op rod assembly and thereafter disengages such that said sear pivots on said sear spring to again extend into the path of the op rod assembly after a single firing of the M240 Assault Rifle.

2. The trigger assembly as in claim 1, wherein said switch is a lever connected to said selector body.

3. The trigger assembly as in claim 2, wherein said selector body is a longitudinal member that rotates about its longitudinal axis within the housing as said lever is moved, said selector body including a clearance cut, wherein said semi-automatic selector surface is a peripheral contact surface of the longitudinal member and said fully-automatic selector surface is an inset clearance cut surface in said longitudinal member.

* * * * *